US008763684B2

(12) United States Patent
Pearson

(10) Patent No.: US 8,763,684 B2
(45) Date of Patent: Jul. 1, 2014

(54) MECHANICAL MUD BUCKET AND METHOD

(75) Inventor: Phillip H. Pearson, Broussard, LA (US)

(73) Assignee: R & D, L.L.C., Broussard, LA (US)

( * ) Notice: Subject to any disclaimer, the term of this patent is extended or adjusted under 35 U.S.C. 154(b) by 529 days.

(21) Appl. No.: 13/097,480

(22) Filed: Apr. 29, 2011

(65) Prior Publication Data

US 2011/0265992 A1 Nov. 3, 2011

Related U.S. Application Data

(60) Provisional application No. 61/330,053, filed on Apr. 30, 2010.

(51) Int. Cl.
*E21B 19/00* (2006.01)

(52) U.S. Cl.
USPC ..... 166/81.1

(58) Field of Classification Search
USPC ..... 166/267, 81.1; 175/207
See application file for complete search history.

(56) References Cited

U.S. PATENT DOCUMENTS

| | | | | | |
|---|---|---|---|---|---|
| 1,448,243 | A * | 3/1923 | Wilson | 166/81.1 |
| 2,032,642 | A * | 3/1936 | Welch | 166/81.1 |
| 2,096,882 | A * | 10/1937 | Chernosky | 166/81.1 |
| 2,214,429 | A * | 9/1940 | Miller | 166/81.1 |
| 2,522,444 | A * | 9/1950 | Grable | 166/81.1 |
| 5,150,751 | A * | 9/1992 | Burton et al. | 166/81.1 |
| 5,295,536 | A * | 3/1994 | Bode | 166/81.1 |
| 5,351,753 | A * | 10/1994 | Golson | 166/81.1 |
| 5,540,283 | A * | 7/1996 | Hahn | 166/379 |
| 5,551,511 | A * | 9/1996 | Holtby | 166/81.1 |
| 5,775,419 | A * | 7/1998 | Gramlich | 166/81.1 |
| 6,119,772 | A * | 9/2000 | Pruet | 166/81.1 |
| 6,286,593 | B1 * | 9/2001 | Holtby | 166/81.1 |
| 2005/0155757 | A1 * | 7/2005 | Paton | 166/81.1 |
| 2005/0205303 | A1 * | 9/2005 | Pearson | 175/57 |

* cited by examiner

*Primary Examiner* — Kenneth L Thompson
*Assistant Examiner* — Michael Wills, III
(74) *Attorney, Agent, or Firm* — Jones Walker LLP

(57) ABSTRACT

A mechanical mud bucket for collecting drilling fluid from tubular members of a drill string or work string. A first shell member includes a fluid outlet. A second shell member is pivotally attached to the first shell member. A seal mechanism and a mechanical locking component are attached to the first and second shell members. In an engaged position, the mechanical locking component locks the first and second shell members in a closed position such that the seal mechanism seals an inner space of the mechanical mud bucket and an annular space between one or more tubular members and the first and second shell members. A pressure control may be attached to the first or second shell members for maintaining atmospheric pressure within the inner space of the mechanical mud bucket when draining drilling fluid.

21 Claims, 8 Drawing Sheets

MECHANICAL MUD BUCKET AND METHOD

CROSS-REFERENCE TO RELATED PATENT APPLICATIONS

This application claims priority to U.S. Provisional Application No. 61/330,053, filed on Apr. 30, 2010, which is incorporated herein by reference.

BACKGROUND

This invention relates to an apparatus and method for collecting a drilling fluid. More particularly, but not by way of limitation, this invention relates to an apparatus and method for collecting a drilling fluid contained within a work string on a drilling rig floor.

In the drilling of wells, and in particular, oil and gas wells, it is necessary to drill a bore hole with use of a tubular work string and boring device. The boring device is generally a bit. A fluid is used in the drilling of the bore hole. The drilling fluid has many purposes including but not limited to the pressure control of subterranean reservoir pressures, bit lubrication, and lifting bore hole cuttings.

In the course of drilling a well, it becomes necessary to lift the work string from the well bore. Under some circumstances, as the operator is pulling the work string from the well bore, the work string may contain, within the inner diameter portion, the fluid. This may be referred to as pulling a wet string. As readily understood by those of ordinary skill in the art, in the process of tripping the work string from the hole, and once a thread connection is undone, the drilling fluid spills out onto the drill floor. From the drill floor, the fluid may be directed to the mud tanks, but may fall off of the rig, and out into the environment. Many times, the drilling fluid may contain harmful and caustic materials. Sometimes, the drilling fluid contains toxic materials. In any case, the prevention of the fluid spillage is important for health, safety and environmental reasons. Under some instances, the prevention of spillage is required by law.

Several prior art bucket devices have been proposed. However, all prior art devices suffer from certain problems. For instance, a proper seal is not formed. Also, prior art devices have inadequate closing and latching mechanisms. Hence, there is a need for an apparatus for efficiently and effectively collecting fluids from work strings. There is also a need for an apparatus and method that will dependably open and close at the direction of the operator.

SUMMARY OF SELECTED EMBODIMENTS OF THE INVENTION

A mechanical mud bucket may include a first shell member, a second shell member pivotally associated with the first shell member, a seal mechanism, a mechanical locking component operatively associated with the first and second shell members, and a pressure control operatively associated with the first shell member or the second shell member. The first shell member may include a first side wall extending from a first upper shoulder to a first lower shoulder and from a first forward surface to a first rearward surface. The first shell member may include a fluid outlet extending through the first side wall. The second shell member may include a second side wall extending from a second upper shoulder to a second lower shoulder and from a second forward surface to a second rearward surface. The seal mechanism may include an upper seal, a lower seal, a forward seal, and a rearward seal. The upper seal may be operatively associated with the first and second upper shoulders. The lower seal may be operatively associated with the first and second lower shoulders. The forward seal may be operatively associated with the first and second forward surfaces. The rearward seal may be operatively associated with the first and second rearward surfaces. In an engaged position, the mechanical locking component may lock the first and second shell members in a closed position such that the seal mechanism seals an inner space defined by the first and second shell members and the upper and lower seals. The pressure control may maintain atmospheric pressure within the inner space with the first and second shell members in the closed position. The second shell member may include a second fluid outlet extending through the second side wall.

The upper seals and the lower seals may be dimensioned to seal an annular space created when the mechanical mud bucket is disposed in the closed position around one or more tubular members. The upper seal may include two sections, one operatively associated with the first upper shoulder and the other operatively associated with the second upper shoulder. The lower seal may include two sections, one operatively associated with the first lower shoulder and the other operatively associated with the second lower shoulder. One section of each of the upper and lower seals may include a projection, and the other section of each of the upper and lower seals may include a groove for engaging the projection. Alternatively, one section of each of the upper and lower seals may include a flexible material component having a projection, and the other section of each of the upper and lower seals may include a flat inflexible surface for engaging the projection.

The forward seal may include two sections, one operatively associated with a first forward rail attached to the first forward surface and the other operatively associated with a second forward rail attached to the second forward surface. The rearward seal may include two sections, one operatively associated with a first rearward rail attached to the first rearward surface, and the other operatively associated with a second rearward rail attached to the second rearward surface. One section of each of the forward and rearward seals may include a projection, and the other section of each of the forward and rearward seals may include a groove for engaging the projection. Alternatively, one section of each of the forward and rearward seals may include a flexible material component having a projection, and the other section of each of the forward and rearward seals may include a flat inflexible surface for engaging the projection. The flexible material component of the forward seal may be disposed within a T-shaped groove in the first forward rail or the second forward rail. The flexible material component of the rearward seal may be disposed within a T-shaped groove in the first rearward rail or the second rearward rail.

The first and second shell members may be attached by one or more hinges affixed to the first and second shell members. The mechanical locking component may include a closing latch or a cam system. Alternatively, the mechanical locking component may include a block attached to a swinging arm, which is pivotally attached to the first side wall, and a receptacle attached to the second side wall. The receptacle may be dimensioned to engage the block thereby locking the first and second shell members in the closed position.

The pressure control may include an opening, a check valve, or a vacuum breaker. The mechanical mud bucket may further include a plurality of handles operatively attached to the first side wall and the second side wall for handling the mechanical mud bucket. The mechanical mud bucket may further include a first lifting attachment extending from an upper end of the first shell member and a second lifting attachment extending from an upper end of the second shell member. The first and second lifting attachments may include an eyelet dimensioned to receive lifting equipment components for lifting the mechanical mud bucket.

A method of recovering a drilling fluid may include providing a mechanical mud bucket, which includes a first shell member having a fluid outlet, a second shell member pivotally associated with the first shell member, a seal mechanism operatively associated with the first and second shell members, a mechanical locking component operatively associated with the first and second shell members, and a pressure control operatively associated with the first shell member or the second shell member. The method may also include positioning the first and second shell members of the mechanical mud bucket in an open position around a threaded connection between an upper tubular member and a lower tubular member of a tubular string containing a drilling fluid. The method may further include moving the first and second shell members into a closed position such that the seal mechanism seals an inner space of the mechanical mud bucket and an annular space between the first and second shell members and the upper and lower tubular members. The method may further include engaging the mechanical locking component such that the first and second shell members are locked in the closed position, threadedly disconnecting the threaded connection, lifting the upper tubular member from the lower tubular member of the tubular string, thereby releasing the drilling fluid from the upper tubular member into the inner space of the mechanical mud bucket. The method may further include draining the drilling fluid from the inner space of the mechanical mud bucket through the fluid outlet in the first shell member while maintaining atmospheric pressure using the pressure control.

The method may further include disengaging the mechanical locking component, moving the first and second shell members into the open position, and repositioning the mechanical mud bucket away from the tubular string.

The mechanical mud bucket may further include a set of lifting attachments extending from an upper end of the first shell member and from an upper end of the second shell member. The positioning and repositioning steps of the method may further include inserting a lifting equipment component through an eyelet in each of the lifting attachments, and using the lifting equipment component to lift and move the mechanical mud bucket.

The second shell member may include a second fluid outlet, and the method may further include plugging the second fluid outlet. Alternatively, the second shell member may include a second fluid outlet, and the draining step of the method may further include draining the drilling fluid from the inner space of the mechanical mud bucket through the second fluid outlet while maintaining atmospheric pressure using the pressure control.

DETAILED DESCRIPTION OF THE PREFERRED EMBODIMENTS

Figure 1:
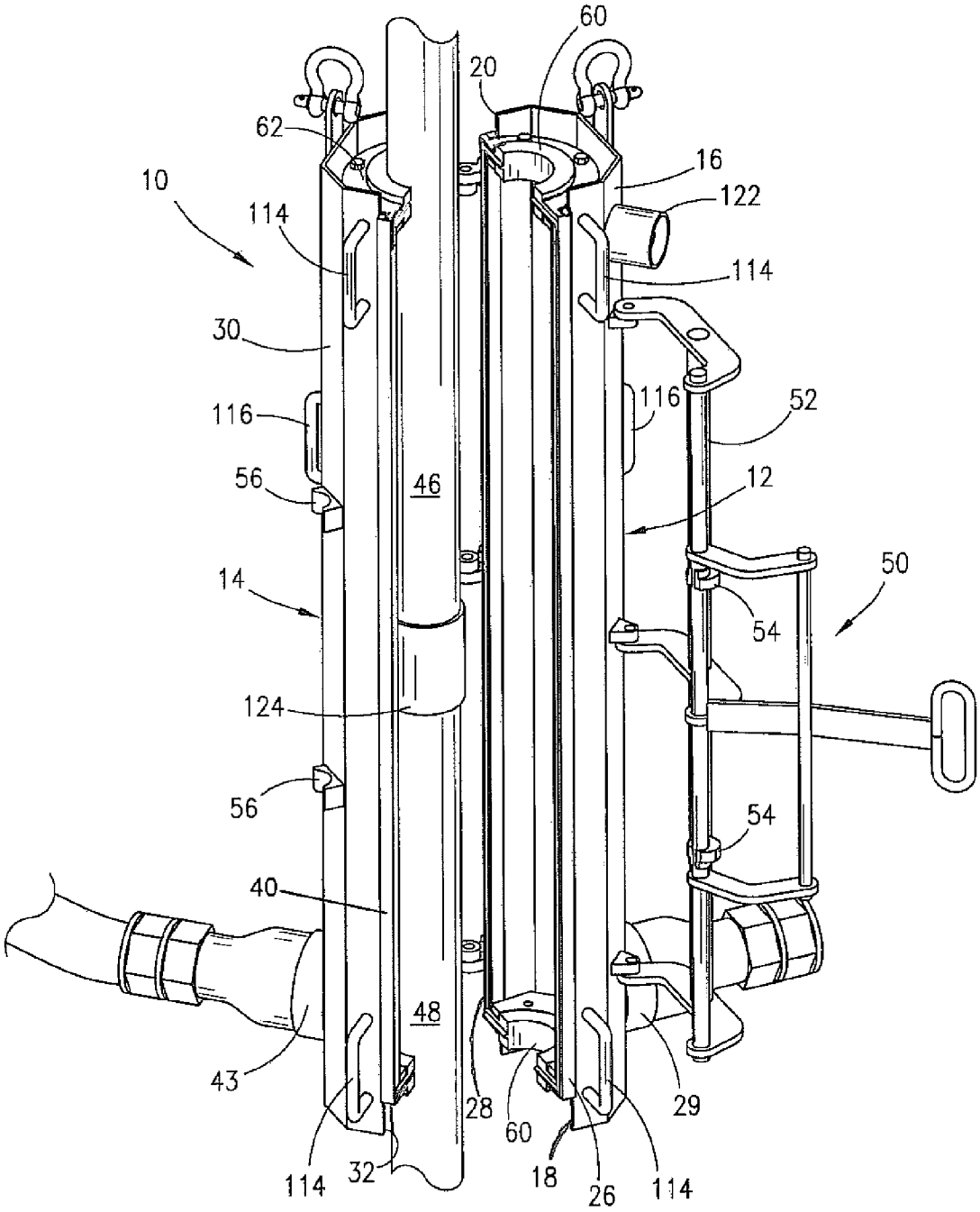
FIG. 1 is a perspective view of a mechanical mud bucket in an open position.
Figure 2:
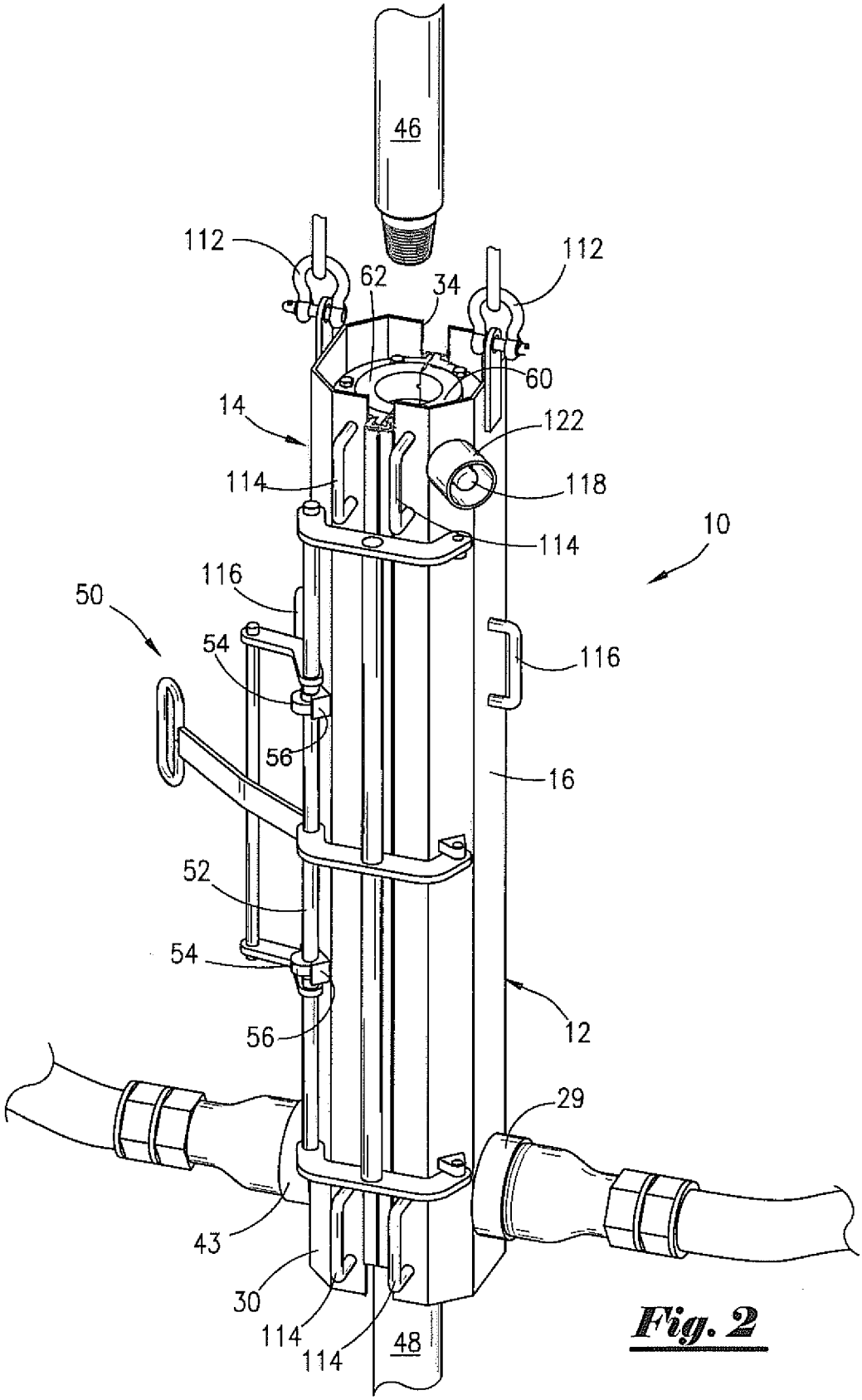
FIG. 2 is a perspective view of the mechanical mud bucket in a closed position.
Figure 3:
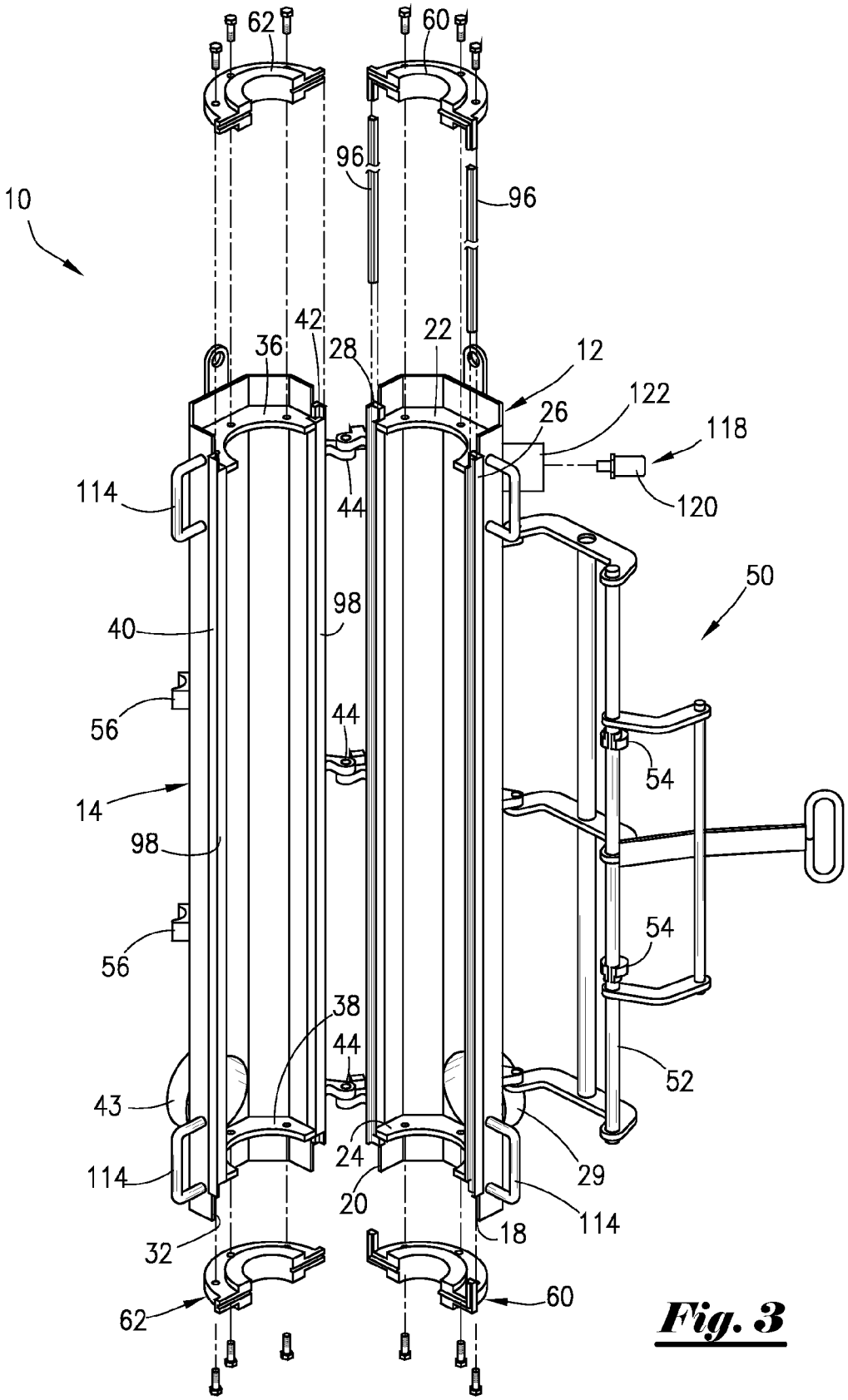
FIG. 3 is an exploded view of the mechanical mud bucket in the open position.

As shown in FIGS. 1-3, mechanical mud bucket 10 may include first and second shell members 12, 14. First shell member 12 may have first side wall 16 extending from first forward surface 18 to first rearward surface 20. First shell member may also include first upper shoulder 22 and first lower shoulder 24 (see FIG. 3). First shell member 12 may further include first forward rail 26 attached to first forward surface 18 and first rearward rail 28 attached to first rearward surface 20. Mechanical mud bucket 10 may include fluid outlet 29 through first side wall 16 of first shell member 12. Fluid outlet 29 may be connected to a conduit as shown in FIG. 2 for draining drilling fluid (or drilling mud) from within mechanical mud bucket 10. A diameter-adjusting component may be connected between fluid outlet 29 and the conduit as shown in FIG. 2. Fluid outlet 29 may have a diameter of 6 inches. The attached conduit used may have any other diameter than 6 inches (e.g., 4 inches).

Second shell member 14 may have second side wall 30 extending from second forward surface 32 to second rearward surface 34 (shown in FIG. 2). Second shell member 14 may also include second upper shoulder 36 and second lower shoulder 38 (see FIG. 3). Second shell member 14 may further include second forward rail 40 attached to second forward surface 32 and second rearward rail 42 (shown in FIG. 3) attached to second rearward surface 34. Mechanical mud bucket 10 may include second fluid outlet 43 through second side wall 30 of second shell member 14. Alternatively, mechanical mud bucket 10 may include only one of fluid outlet 29 and second fluid outlet 43. Second fluid outlet 43 may be connected to a conduit as shown in FIG. 2 for draining drilling fluid (or drilling mud) from within mechanical mud bucket 10. A diameter-adjusting component may be connected between second fluid outlet 43 and the conduit as shown in FIG. 2. Second fluid outlet 43 may have a diameter of 6 inches. The attached conduit used may have any other diameter than 6 inches (e.g., 4 inches).

Shell members 12, 14 may be attached by one or more hinges 44 affixed to first side wall 16 and second side wall 30 of shell members 12, 14. Shell member 12, 14 may be capable of being closed around one or more pipe sections, such as upper tubular member 46 and lower tubular member 48. Tubular members 46, 48 may be part of a tubular string (e.g., a drill string or work string) which contains drilling fluid (or drilling mud). In the closed position, shell members 12, 14 may form an octagonal-shaped mechanical mud bucket 10 (shown in FIGS. 2 and 11).

Mechanical mud bucket 10 may also include mechanical locking component 50. Mechanical locking component 50 may be a closing latch, a cam system, or a combination of two. In the embodiment shown in FIGS. 1-3, swinging arm assembly 52 may be pivotally attached to first side wall 16 of first shell member 12. For example, a mount may be welded or otherwise attached to first side wall 16, and swinging arm assembly 52 may be pivotally attached to the mount (e.g., by bolt or with a bushing). Swinging arm assembly 52 may include blocks 54. Receptacles 56 may be attached to second side wall 30 of second shell member 14. Receptacles 56 may be dimensioned to receive and engage blocks 54, thereby locking together forward surfaces 18, 32 and rearward surfaces 20, 34 of shell members 12, 14. Alternatively, swinging arm assembly 52 may be pivotally attached to second shell member 14 and receptacles 56 may be attached to first shell member 12. In this alternative embodiment, mechanical locking component 50 functions in the same way as described above to lock together forward surfaces 18, 32 and rearward surfaces 20, 34.

Mechanical mud bucket 10 may further include a seal mechanism which may include an upper end seal, a lower end seal, a forward seal, and a rearward seal. When shell members 12, 14 are in a closed position around tubular members (e.g., upper and lower tubular member 46, 48), the upper end seal and the lower end seal may each seal an annular space between the tubular members and the upper and lower shoulders 22, 24, 36, 38. The upper end seal and the lower end seal may each include first end seal 60 and second end seal 62. First end seal 60 of upper end seal may be attached to first upper shoulder 22 (e.g., by bolt, screw, or welding), and second end seal 60 of upper end seal may be attached to second upper shoulder 36 (e.g., by bolt, screw, or welding). First end seal 60 of lower end seal may be attached to first lower shoulder 24 (e.g., by bolt, screw, or welding), and second end seal 62 of lower end seal may be attached to second lower shoulder 38 (e.g., by bolt, screw, or welding).

Figure 4:
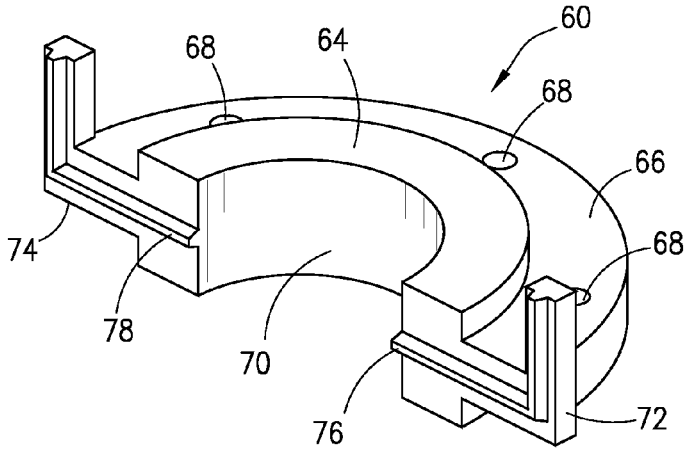
FIG. 4 is a perspective view of a first end seal of the mechanical mud bucket.
Figure 5:
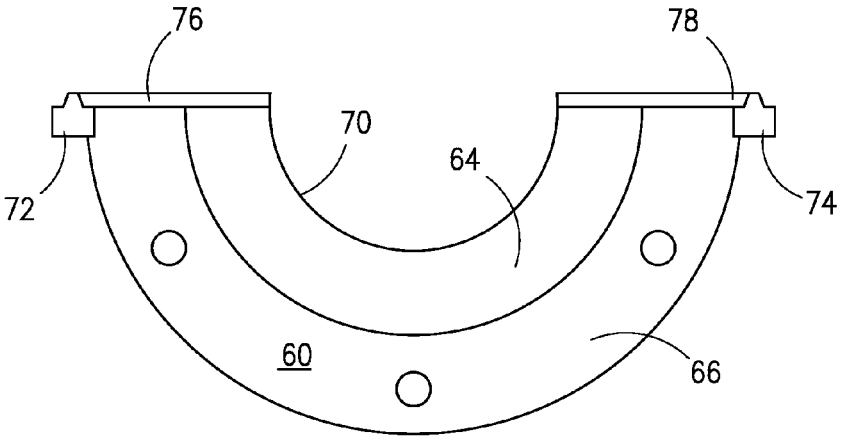
FIG. 5 is a top view of the first end seal.
Figure 6:
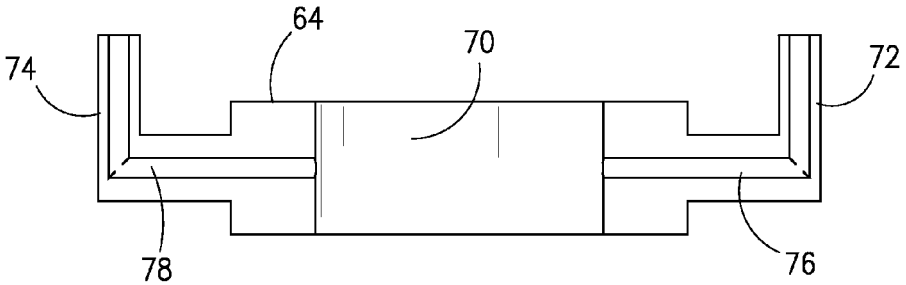
FIG. 6 is a side view of the first end seal.

Referring now to FIGS. 4-6, first end seal 60 includes sealing component 64 attached to plate 66. Plate 66 may include one or more apertures 68 for connecting first end seal 60 to first upper shoulder 22 or first lower shoulder 24 by bolt or screw. Sealing component 64 may be formed of a flexible material (i.e., rubber). Sealing component 64 may be one continuous piece, or alternatively, may be composed of several pieces attached to plate 66. Sealing component 64 may include annular sealing section 70 and L-shaped sealing sections 72, 74. Projections 76, 78 may extend along the length of L-shaped sealing sections 72, 74, respectively.

Figure 7:
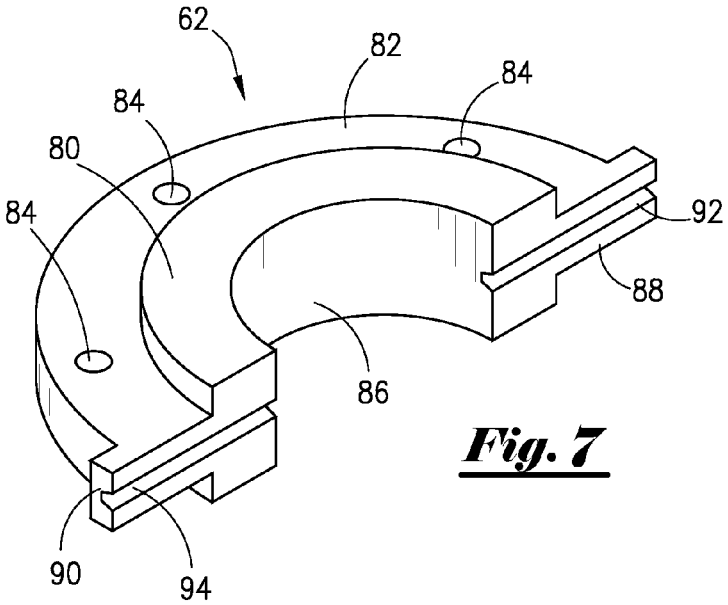
FIG. 7 is a perspective view of a second end seal of the mechanical mud bucket.
Figure 8:
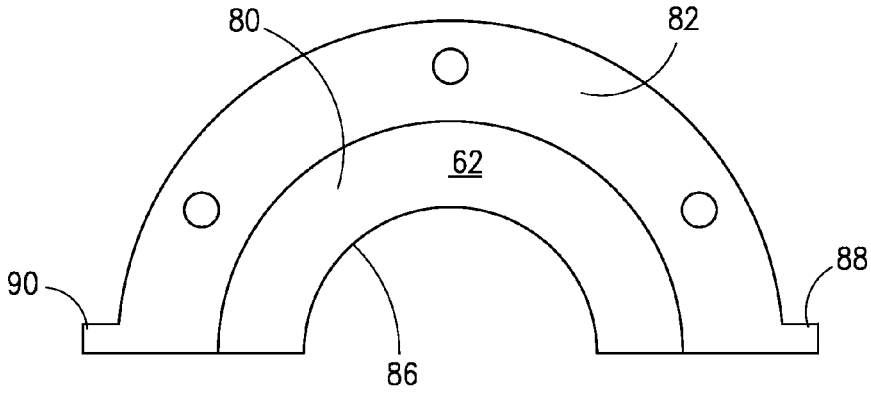
FIG. 8 is a top view of the second end seal.
Figure 9:
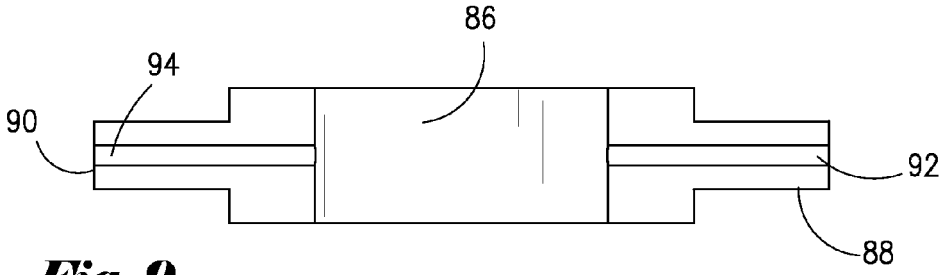
FIG. 9 is a side view of the second end seal.

Referring now to FIGS. 7-9, second end seal 62 includes sealing component 80 attached to plate 82. Plate 82 may include one or more apertures 84 for connecting second end seal 62 to second upper shoulder 36 or second lower shoulder 38 by bolt or screw. Sealing component 80 may be formed of a flexible material (i.e., rubber). Sealing component 80 may be one continuous piece, or alternatively, may be composed of several pieces attached to plate 82. Sealing component 80 may include annular sealing section 86 and sealing sections 88, 90. Grooves 92, 94 may extend along the length of sealing sections 88, 90, respectively.

Figure 10:
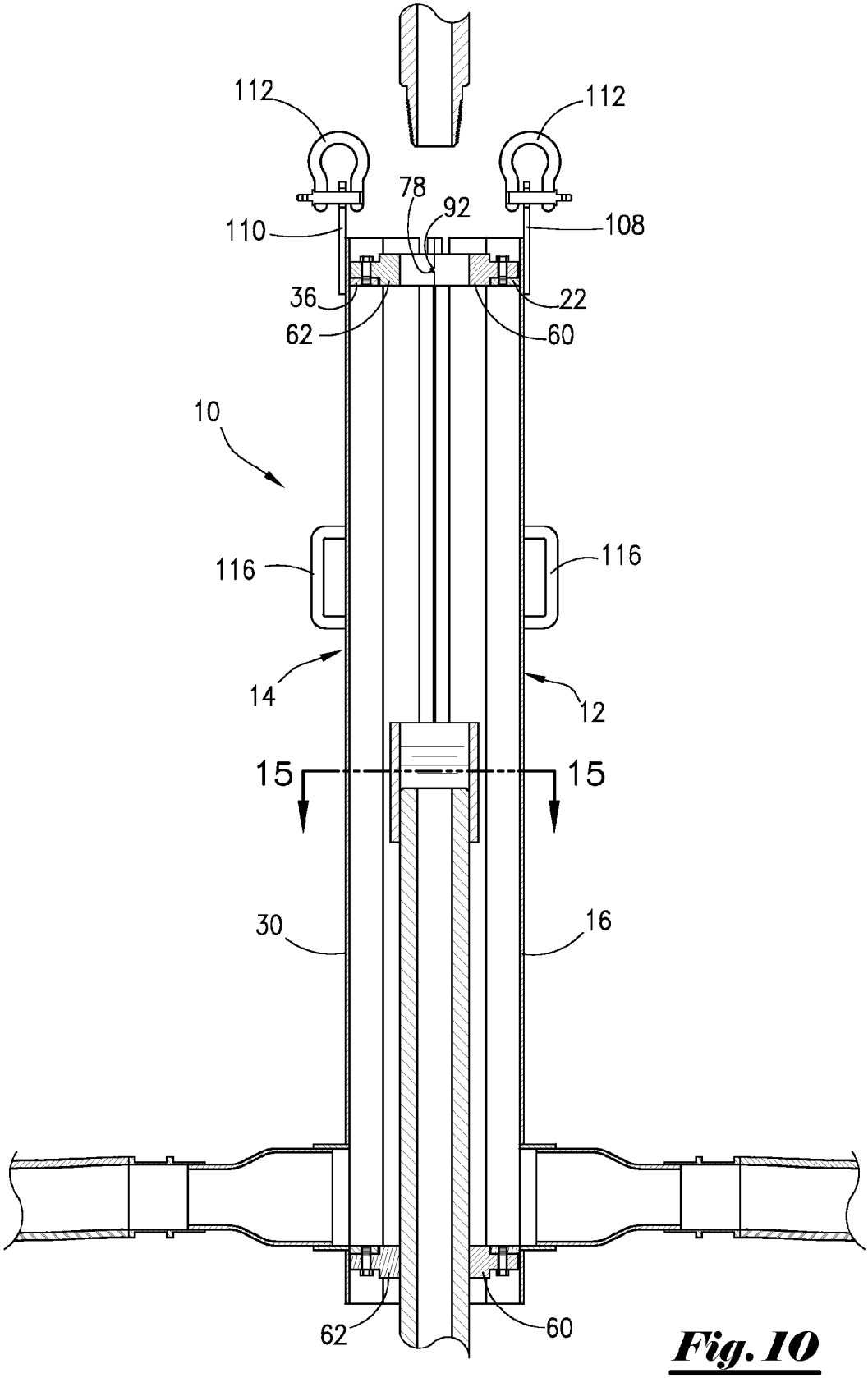
FIG. 10 is a cross-sectional view of the mechanical mud bucket in the closed position.
Figure 11:
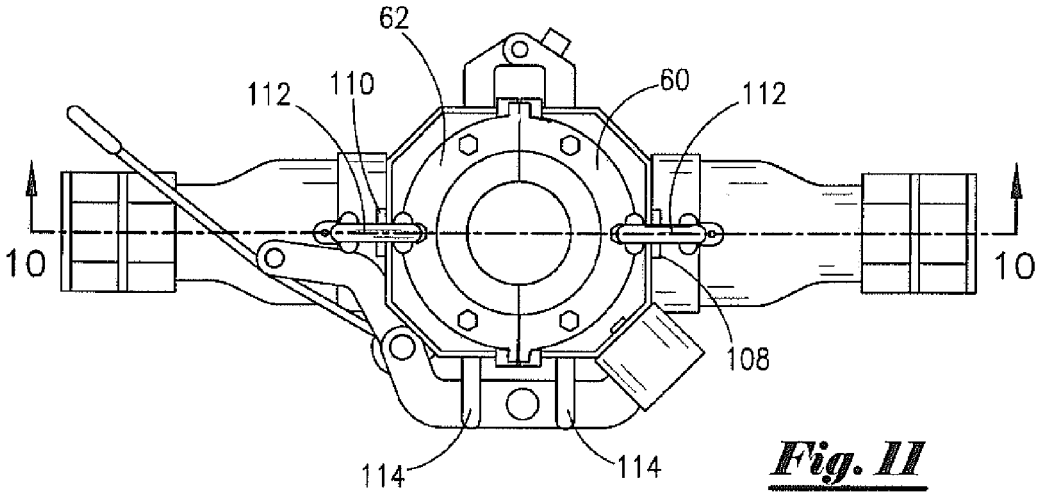
FIG. 11 is a top view of the mechanical mud bucket in the closed position.
Figure 12:
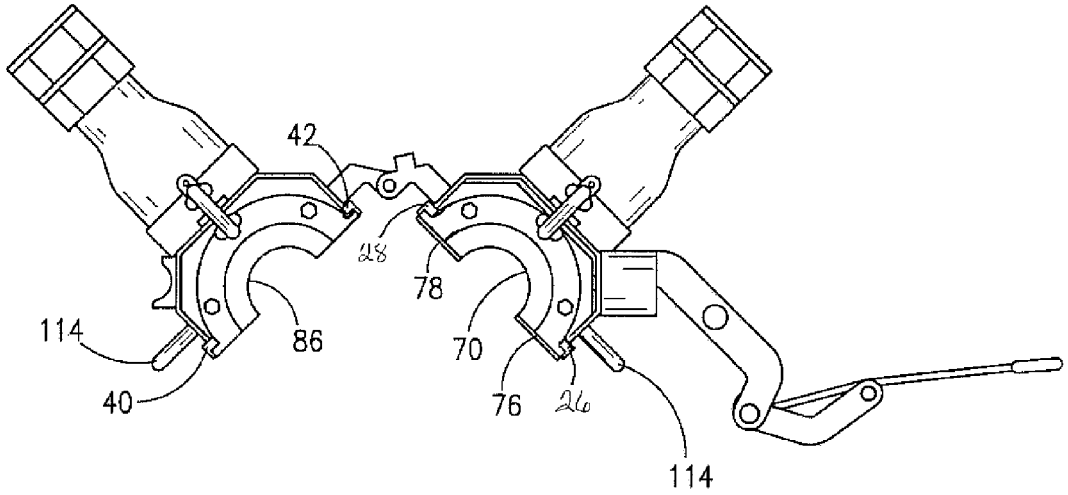
FIG. 12 is a top view of the mechanical mud bucket in the open position.

FIGS. 10-11 illustrate mechanical mud bucket 10 in the closed position and FIG. 12 illustrates mechanical mud bucket 10 in the open position. In the closed position, first and second end seals 60, 62 of upper end seal engage one another, i.e., grooves 92, 94 of second end seal 62 engage projections 76, 78 of first end seal 60. L-shaped sealing sections 72, 74 of first end seals 60 may be inserted into each end of first forward rail 26 and first rearward rail 28. First and second end seals 60, 62 determine the size of tubular members that will fit within mechanical mud bucket 10 in the closed position. Mechanical mud bucket 10 may include multiple sets of first and second end seals 60, 62 with differing diameters of annular sealing sections 70, 86. Alternatively, mechanical mud bucket 10 may include only two sets of first and second end seals 60, 62 (one set for the upper end seal and one set for the lower end seal), and instead include multiple annular sealing sections 70, 86 or entire sealing components 64, 80 that may be attached to and removed from plates 66, 82. The variable seals may be designed to accommodate tubular members having the following outer diameters: 6⅝ inches, 5⅞ inches, 5 inches, 4½ inches, 4 inches, 3½ inches, 2⅞ inches, 2⅜ inches.

Referring again to FIGS. 1-3, the forward seal and the rearward seal both seal between first and second forward surfaces 18, 32 and first and second rearward surfaces 20, 34, respectively, when shell members 12, 14 are in the closed position. The forward seal and rearward seal may each include first side seal component 96 and second side seal component 98 (see FIG. 3). First side seal component 96 of the forward seal may be inserted through first forward rail 26 of first shell member 12. Second side seal component 98 of the forward seal may be a flat inflexible surface of second forward rail 40 with which first side seal component 96 engages. First side seal component 96 of the rearward seal may be inserted through first rearward rail 28 of first shell member 12. Second side seal component 98 of the rearward seal may be a flat inflexible surface of second rearward rail 42 with which first side seal component 96 engages.

Figure 13:
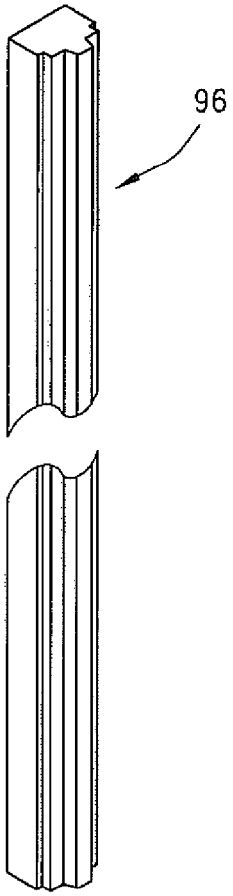
FIG. 13 is a perspective view of a side seal of the mechanical mud bucket.
Figure 14:
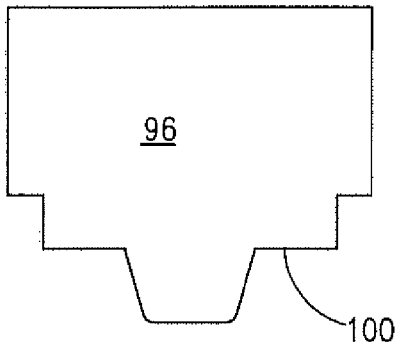
FIG. 14 is a top view of the side seal.
Figure 15:
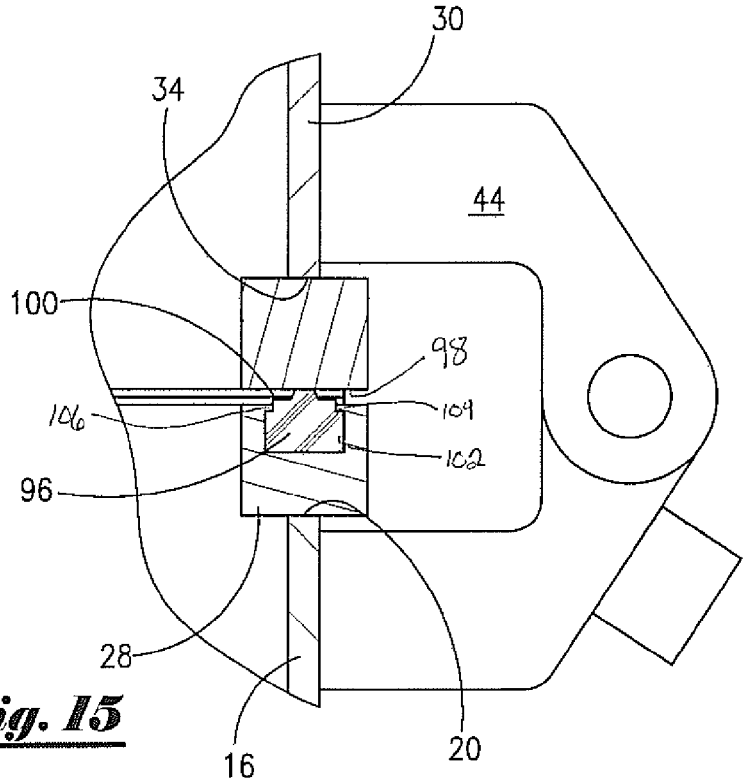
FIG. 15 is a partial cross-sectional view of the mechanical mud bucket with the side seal of FIGS. 13-14.

Referring now to FIGS. 13-15, first side seal component 96 may have stepped projection profile 100. First side seal component 96 may be formed of a flexible material (e.g., rubber). First rearward rail 28 may have T-shaped groove 102 into which first side seal component 96 may be inserted. Stepped projection profile 100 may interact with projections 104, 106 of T-shaped groove 102 such that first side seal component 96 is held securely within T-shaped groove 102. Stepped projection profile 100 may engage second side seal component 98 to complete the rearward seal. The second side seal component 98 may be formed of an inflexible material (e.g., carbon steel). Alternatively, projection profile 100 may have a rounded intermediate step instead of the square intermediate step as shown in FIG. 14. This rounded intermediate step may project out further than the square intermediate step shown in FIG. 14, providing more surface area for sealing.

In the same way, first forward rail 26 may have T-shaped groove 102 into which first side seal component 96 may be inserted. Stepped projection profile 100 of first side seal component 96 may interact with projections 104, 106 of T-shaped groove 102 of first forward rail 26 such that first side seal component 96 is held securely within T-shaped groove. Stepped projection profile 100 of first side seal component 96 of the forward seal may engage second side seal component 98 of the forward seal to complete the forward seal.

Alternatively, first forward rail 26 and first rearward rail 28 may not include a T-shaped groove and instead include only an L-shaped support for first side seal component 96. In another alternative, second side seal component 98 of the forward and rearward seals are flexible members including a groove for engaging first side seal component 96. In this alternative, second forward rail 40 and second rearward rail 42 may include an L-shaped support only or a T-shaped groove. In yet another embodiment, the seal mechanism of mechanical mud bucket 10 may include only one continuous piece which forms the upper end seal, the lower end seal, the forward seal, and the rearward seal.

Referring again to FIGS. 10-12, mechanical mud bucket 10 may also include lifting attachment 108 attached to first shell member 12 and lifting attachment 110 attached to second shell member 14. Lifting attachments 108, 110 include eyelets through which a bolt or other similar component of a lifting apparatus (e.g., a crane system) may be inserted to accomplish lifting or otherwise moving mechanical mud bucket 10. For example, FIGS. 10 and 11 illustrate shackle 112 with a bolt disposed through an eyelet of each lifting attachment 108, 110. A cable, chain, or rope may then be attached to shackle 100 (as shown in FIG. 2) for lifting mechanical mud bucket 10.

Referring now to FIGS. 1-3 and 10-12, mechanical mud bucket 10 may further include one or more front handles 114 and one or more side handles 116 attached to first shell member 12 and second shell member 14. Front and side handles 114 and 116 may be used for handling mechanical mud bucket 10, guiding the movement of mechanical mud bucket 10 while suspended from a lifting apparatus, moving shell members 12, 14 between the open position and the closed position, or any other movement of mechanical mud bucket 10.

Referring now to FIGS. 2-3, mechanical mud bucket 10 may further include pressure control 118 attached to an upper portion of first shell member 12. Pressure control 118 may be a vacuum breaker having cover 120, which may be composed of brass. To protect cover 120, shielding surface 122 may be affixed to first shell member 12 around a receptacle into which pressure control 118 is inserted. In one embodiment, shielding surface 122 may include a three-inch pipe welded around a three-quarter inch collar to which pressure control 118 is threadedly connected. The vacuum breaker used may be a model 62 vacuum breaker sold by Hoffman Specialty of ITT Corporation.

Alternatively, pressure control 118 may include any other device which allows air to enter an inner space of mechanical mud bucket 10 without allowing drilling fluid (or drilling mud) to exit the mechanical mud bucket 10 in any way other than through fluid outlet 29 or secondary fluid outlet 43. For example, pressure control 118 may include a check valve. In another alternative embodiment, pressure control 118 may include only an opening in first side wall 16, which may lead to leakage of drilling fluid from within mechanical mud bucket 10. This alternative embodiment may be helpful to save money where 100% recovery of drilling fluid is not required.

With reference again to FIGS. 1-3, mechanical mud bucket 10 in the open position (as shown in FIG. 1) may be placed around a drill string containing drilling fluid (or drilling mud) such that the upper-most junction, such as threaded connection 124 between upper tubular member 46 and lower tubular member 48, is disposed within shell members 12, 14. A component of lifting equipment may be connected to lifting attachments 108 and 110 to move mechanical mud bucket 10. Shell members 12, 14 may be closed using front handles 114 and side handles 116. In the closed position (as shown in FIG. 2), the upper end seal and the lower end seal each seal the annular space between tubular members 46, 48 and upper and lower shoulders 22, 24, 36, 38 (shown in FIG. 3). In the closed position, the forward seal seals the space between first forward surface 18 and second forward surface 32, and the rearward seal seals the space between first rearward surface 20 and second rearward surface 34. Mechanical locking component 50 may be engaged by pivoting swinging arm assembly 52 such that receptacle 56 engages block 54 of swinging arm assembly 52 thereby locking shell members 12, 14 in the closed position.

Depending upon the conditions and arrangement of equipment at the work site, a choice may be made as to whether only fluid outlet 29, only secondary fluid outlet 43, or both fluid outlet 29 and secondary fluid outlet 43 should be used for draining drilling fluid from the inner space of mechanical mud bucket 10. As shown in FIG. 1, if only secondary fluid outlet 43 will be used to drain drilling fluid, then fluid outlet 29 is blocked and a conduit is attached to secondary fluid outlet 43. Alternatively, if only fluid outlet 29 will be used to drain drilling fluid, then secondary fluid outlet 43 is blocked and a conduit is attached to fluid outlet 29. In yet another alternative, if both fluid outlet 29 and secondary fluid outlet 43 will be used to drain drilling fluid, then conduits are attached to both as shown in FIG. 2. Any conduits attached will be in fluid communication with fluid outlet 29 or secondary fluid outlet 43 for draining and collecting drilling fluid from the inner space of mechanical mud bucket 10.

Upper tubular member 46 may be rotated out of engagement with lower tubular member 48, thereby breaking threaded connection 124 positioned within mechanical mud bucket 10. Drilling fluid may flow out of upper tubular member 46 upon lifting it from lower tubular member 48. With the lower end of upper tubular member 46 remaining in mechanical mud bucket 10, the drilling fluid will flow through fluid outlet 29 or secondary fluid outlet 43 (or both), through the conduit(s), which may be attached to a recovery system. While draining drilling fluid from the inner space of mechanical mud bucket 10, pressure control 118 will allow air to enter the inner space to maintain atmospheric pressure in the inner space thereby allowing the drilling fluid to drain more quickly. The drilling fluid may be stored in the recovery system for future use. Alternatively, the drilling fluid may be discarded in a safe manner.

After draining all drilling fluid from upper tubular member 46 and mechanical mud bucket 10, mechanical locking component 50 may be disengaged by removing blocks 54 from receptacles 56 and pivoting swinging arm assembly 52 away from second shell member 14. Shell members 12, 14 may then be pivoted into the open position. Upper tubular member 46 may be moved away from lower tubular member 48 (and the drill string). The drill string may then be lifted further such that the next junction is positioned within mechanical mud bucket 10. The process may then be repeated.

When the process is complete, the mechanical mud bucket may be transported conveniently away from the job site, such as by pickup truck. The seal mechanism does not leak, allowing 100% recovery of drilling mud or fluid. By preventing the spillage of drilling fluid (or drilling mud), the seal mechanisms protect workers, prevent environmental pollution, and decrease costs of wasted drilling fluid.

All components of mechanical mud bucket 10 may be composed of carbon steel or any other metal of sufficient strength and durability. As discussed above, certain components of the seal mechanism may be composed of a flexible material (e.g., rubber) to allow for flexibility in sealing mechanical mud bucket 10.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A mechanical mud bucket comprising:

a first shell member having a side wall extending from an upper shoulder to a lower shoulder and from a forward surface to a rearward surface, said first shell member including a fluid outlet extending through said side wall, each of the upper and lower shoulders having an external surface, an internal surface, and an interconnecting side surface;

a forward rail attached to the forward surface of the first shell member;

a rearward rail attached to the rearward surface of the first shell member;

a second shell member pivotally associated with the first shell member, said second shell member having a side wall extending from an upper shoulder to a lower shoulder and from a forward surface to a rearward surface, each of the upper and lower shoulders of the second shell member having an external surface, an internal surface, and an interconnecting side surface;

a forward rail attached to the forward surface the second shell member;

a rearward rail attached to rearward surface of the second shell member;

a seal mechanism including an upper seal, a lower seal, a forward seal, and a rearward seal a mechanical locking component operatively associated with said first and second shell members, wherein in an engaged position said mechanical locking component locks said first and second shell members in a closed position such that said seal mechanism seals an inner space defined by said first and second shell members and said upper and lower seals;

a pressure control operatively associated with said first shell member or said second shell member such that said pressure control maintains an atmospheric pressure within the inner space with said first and second shell members in the closed position;

wherein each of the upper and lower seals includes a first end seal and a second end seal, the first end seal having a plate member, a central sealing component with an annular sealing section shaped to receive a tubular string, and two L-shaped sealing sections positioned at opposite ends of the first end seal, each L-shape sealing section including a horizontal extending portion and a vertically extending portion with a projection extending the length thereof, and the second end seal having a plate member, a central sealing component with an annular sealing section, and two sealing end sections positioned at opposite ends of the second end seal, each sealing end section containing a groove shaped to receive in mating arrangement the projection of the horizontally extending portion of one of the L-shaped sealing sections of the first end seal;

wherein the first end seal of the upper seal affixed to the external surface of the upper shoulder of the first shell member, and the second of the second shell member;

wherein the first end seal of the lower seal is affixed to the external surface of the lower shoulder of the first shell member, and the second end seal of lower seal is affixed the external surface of the lower shoulder of the second shell member;

wherein an upper end of each of the forward and rearward rails of the first shell member receives in cooperating arrangement the vertically extending portion of one of the L-shaped sealing sections of the first end seal of the upper seal;

wherein a lower end of each of the forward and rearward rails of the first shell member receives in cooperating arrangement the vertically extending portion of one of L-shaped sealing of the first end seal of the lower seal.

2. The mechanic mud bucket claim 1, wherein said second shell member includes a second fluid outlet extending through said side wall.

3. The mechanical mud bucket of claim 1, wherein said upper and lower are each dimensioned seal an annular space created when the mechanical mud bucket is disposed in the closed position around the tubular string.

4. The mechanical mud bucket of claim 1, wherein the projection of each of said L-shaped sealing sections of the first end seal of each of the upper and lower seals is made of a flexible material, and wherein the sealing end sections of the second end seal of each of the upper and lower seals have an inflexible surface.

5. The mechanical mud bucket of claim 1, wherein said forward seal includes a first seal section and a second seal section, the first seal section is operatively associated with a the forward rail of the first shell member and the second seal section is operatively associated with the forward rail of the second member, and wherein said rearward seal includes a first seal section and second seal section, the first seal section is operatively associated with the rearward rail of the first shell member and the second seal section is operatively associated with the rearward rail of the second shell member.

6. The mechanical mud bucket of claim 5, wherein the first seal section of the forward seal includes a projection extending the length thereof and the second seal section of the forward seal includes a groove shaped to receive in mating arrangement the projection of the first seal section, and wherein the first seal section of the rearward seal includes a projection extending the length thereof and the second seal section of the rearward seal includes a groove shaped to receive in mating arrangement the projection of the first seal section.

7. The mechanical mud bucket of claim 5, wherein the first seal section of the forward seal includes a projection made of a flexible material extending the length thereof and the second seal section of the forward seal includes a flat inflexible surface for engaging the projection;

wherein the first seal section of the rearward seal includes a projection made of a flexible material extending the length thereof and the second seal section of the rearward seal includes flat inflexible surface for engaqing the projection;

wherein the forward rail of the first shell member includes T-shaped groove for disposition of the first seal section of the forward seal and the rearward rail of the first shell member includes a T-shaped groove for disposition of the first seal section of the rearward seal;

wherein the first seal section of the forward seal is disposed within the T-shaped groove of the forward rail of the first shell member and the first seal section of the rearward seal is disposed within the T-shaped groove of the rearward rail of the first shell member.

8. The mechanical mud bucket of claim 1, wherein said first and second shell members are attached by one or more hinges affixed to said first and second shell members.

9. The mechanical mud bucket of claim 1, wherein said mechanical locking component includes a closing latch or a cam system.

10. The mechanical mud bucket claim 1, wherein said mechanical locking component includes:

a block attached to a swinging arm, said swinging arm pivotally attached to said side wall of the first shell member; and a receptacle attached to said side wall of the second shell member, said receptacle dimensioned to engage said block thereby locking said first and second shell members in the closed position.

11. The mechanical mud bucket of claim 1, wherein the pressure control is an opening, a check valve, or a vacuum breaker.

12. The mechanical mud bucket of claim 1, further comprising a plurality of handles operatively attached to the side wall of the first shell member and the side wall of the second shell member for handling said mechanical mud bucket.

13. The mechanical mud bucket of claim 1, further comprising a first lifting attachment extending from an upper end of the first shell member and a second lifting attachment extending from an upper end of the second shell member, wherein each said first and second lifting attachments include an eyelet dimensioned to receive lifting equipment components for lifting the mechanical mud bucket.

14. The mechanical mud bucket of claim 1, wherein the first end seal of the upper seal is detachably affixed to the external surface of the upper shoulder of the first shell member, and the second end seal of the upper seal is detachably affixed to the external of the upper shoulder of the second shell member.

15. The mechanical mud bucket of claim 14, wherein the first end seal of the lower seal is detachably affixed to the external surface of the lower shoulder of the first shell member, and the second end seal of the lower seal is detachably affixed to the external surface of the lower shoulder the second shell member.

16. The mechanical mud bucket of claim 15, wherein the plate member of the first end seal of the upper seal contains a plurality of apertures that align a plurality of apertures in the upper shoulder of the first shell member and wherein the first end seal of the upper seal is detachably affixed to the external surface of upper shoulder of the first shell member by a plurality of bolts or screws, each disposed through one of a pair of aligned apertures in the plate member and upper shoulder;

wherein the plate member of the second end seal of the upper seal contains a plurality of apertures that align with a plurality of apertures in the upper shoulder of the second shell member and wherein the second end seal of the upper seal is detachably affixed to the external surface of upper shoulder of the second shell member by a plurality of bolts or screws, each disposed through one of a pair of aligned apertures in the plate member and upper shoulder.

17. A method of recovering a drilling fluid comprising the steps of:

a) providing a mechanical mud bucket comprising a first shell member having a side wall extending from an upper shoulder to a lower shoulder and from a forward surface to a rearward surface, said first shell member including a fluid outlet extending through said side wall, each of the upper and lower shoulders having an external surface, an internal surface, and an interconnectinq side surface; a forward attached to the forward surface of the first shell member; rearward rail attached to the rearward surface of first shell member; a second shell member pivotally associated with the first shell member, said second shell member having a side wall extending from an upper shoulder to a lower shoulder and from a forward surface to a rearward surface, each of the upper and lower shoulders of the second shell member having an external surface, an internal surface, and an interconnectinq side surface; a forward rail attached to the forward surface of the second shell member; a rearward rail attached to the rearward surface of the second shell member; seal mechanism including an upper seal, a lower seal, a forward seal, and a rearward seal; a mechanical locking component operatively associated with said first and second shell members, wherein in an engaqed position said mechanical locking component locks said first and second shell members in a closed position such that said seal mechanism seals an inner space defined by said first and second shell members and upper and lower seals; a pressure control operatively associated with said first shell member or said second shell member such that said pressure control maintains an atmospheric pressure within the inner space with said first and second shell members in the closed position; wherein each of the upper and lower seals includes first end seal and a second end seal, the first end having a plate member, a central sealing component with an annular sealing section shaped to receive a tubular string, and two L-shaped sealing sections positioned at opposite ends of the first end seal, each L-shaped sealing section including a horizontal extending portion and a vertically extending portion with a projection extending the length thereof, and the second end seal having a plate member, a central sealing component with an annular sealing section, and two sealing end sections positioned at opposite ends of the second end seal, each sealing end section containing a groove shaped to receive in mating arrangement the projection of the horizontally extending portion of one of the L-shaped sealing sections of the first end seal; wherein a first end seal of the upper seal is detachably affixed to the external surface of the upper shoulder of the first shell member, and the second end seal of the upper seal is detachably affixed to the external surface of the upper shoulder of the second shell member; wherein the first end seal of the lower seal is detachably affixed to the external surface of the lower shoulder of the first shell member, and the second end seal of the lower seal detachably affixed to the external surface of the lower shoulder of the second shell member; wherein an upper end of each of the forward and rearward rails of the first shell member receives in cooperating arrangement the vertically extending portion of one of the L-shaped sealing sections of the first end seal of the upper seal; wherein a lower end of each of the forward rearward rails of the first shell member receives in cooperating arrangement the vertically extending portion of one of the L-shaped sealing sections of the first end seal of the lower seal;

b) positioning said first and second shell members of said mechanical mud bucket in an open position around a threaded connection between an upper tubular member and a lower tubular member of the tubular string, wherein said tubular string contains a drilling fluid;

c) moving said first and second shell members into a closed position such that said seal mechanism seals an inner space of the mechanical mud bucket and an annular space between said first and second shell members and said upper and lower tubular members;

d) engaging the mechanical locking component such that said first and second shell members are locked in the closed position;

e) threadedly disconnecting said threaded connection and lifting the upper tubular member from the lower tubular member of the tubular string, thereby releasing the drilling fluid from the upper tubular member into the inner space of the mechanical mud bucket; and f) draining the drilling fluid from the inner space of the mechanical mud bucket through the fluid outlet in the first shell member while maintaining atmospheric pressure using the pressure control.

18. The method of claim 17, further comprising the steps of:

g) disengaging the mechanical locking component;

h) moving the first and second shell members into the open position; and i) repositioning the mechanical mud bucket away from the tubular string.

19. The method of claim 18, wherein said mechanical mud bucket includes a lifting eyelet positioned on an upper end of the first shell member and a lifting eyelet positioned on an upper end of the second shell member, and wherein in step (b) the mechanical mud bucket is positioned by transporting the mechanical mud bucket via a lifting means connected to each of the lifting eyelets.

20. The method of claim 17, wherein said second shell member includes a second fluid outlet, the method further comprising the step of:

d1) plugging said second fluid outlet.

21. The method of claim 17, wherein said second shell member includes a second fluid outlet, the method further comprising the step of:

f1) draining the drilling fluid from the inner space of the mechanical mud bucket through the second fluid outlet while maintaining atmospheric pressure using the pressure control.

* * * * *